US005913347A

United States Patent [19]

Wilen

[11] Patent Number: 5,913,347

[45] Date of Patent: Jun. 22, 1999

[54] MOP HEAD WITH INTEGRAL FUSED BRUSH ARRAY

[75] Inventor: Joseph M. Wilen, Atlanta, Ga.

[73] Assignee: Wilen Acquisition Corporation, Wrens, Ga.

[21] Appl. No.: 08/954,805

[22] Filed: Oct. 21, 1997

[51] Int. Cl.[6] ..... A47L 13/12; A47L 13/20; A46B 3/06

[52] U.S. Cl. ..... 15/115; 15/147.1; 15/151; 15/187; 15/193; 15/229.2

[58] Field of Search ..... 15/114, 115, 116.1, 15/147.1, 150, 151, 186, 187, 192, 193, 228, 229.1, 229.2, 229.6

[56] References Cited

U.S. PATENT DOCUMENTS

| | | | |
|---|---|---|---|
| 1,840,189 | 1/1932 | Dwork | 15/115 |
| 2,196,365 | 4/1940 | Schulman | 15/115 X |
| 2,304,961 | 12/1942 | Schulman | 15/115 X |
| 2,637,867 | 5/1953 | Kalinowski | 15/115 |
| 2,845,643 | 8/1958 | Provencal et al. | 15/115 X |
| 3,328,822 | 7/1967 | Sellesi | 15/229.2 X |
| 3,447,183 | 6/1969 | McClung et al. | 15/229.2 X |
| 3,452,383 | 7/1969 | Eichner | 15/147.1 |
| 3,728,756 | 4/1973 | Argeris et al. | 15/229.2 |
| 4,531,251 | 7/1985 | Pappas et al. | 15/147.1 |
| 4,646,381 | 3/1987 | Weihrauch | 15/187 X |
| 5,155,875 | 10/1992 | Kirkkala et al. | 15/183 |
| 5,349,715 | 9/1994 | Lewis, Jr. | 15/114 |
| 5,524,314 | 6/1996 | Dickinson et al. | 15/105 |
| 5,706,544 | 1/1998 | Young | 15/115 |

FOREIGN PATENT DOCUMENTS

| | | | |
|---|---|---|---|
| 472857 | 3/1992 | European Pat. Off. | 15/193 |

*Primary Examiner*—Mark Spisich
*Attorney, Agent, or Firm*—Womble Carlyle Sandridge & Rice, PLLC

[57] ABSTRACT

A dual-purpose mop head assembly comprising a housing having a threaded recess for threadably engaging a handle on one end thereof, mopping yarns secured within and extending from the opposite end of the housing, and an array of closely packed, brush bristles fused to and projecting laterally from a side of the housing.

8 Claims, 2 Drawing Sheets

MOP HEAD WITH INTEGRAL FUSED BRUSH ARRAY

FIELD OF INVENTION

The present invention relates to a mop head assembly having an array of fused brush bristles extending laterally from a mop housing, where the conventional mopping yarns are mounted to and extend essentially perpendicular relative to the bristles.

BACKGROUND OF THE INVENTION

Mop heads of a variety of types and sizes are well known in the field of janitorial and household equipment, including mop heads for supporting string-like mop swabs and mop heads for supporting sponge mops. These mop heads are generally constructed of metals, plastics, or some combination thereof, and may range from a few components to a number of components.

Most of the heads in current use are intended to be user friendly by reducing or eliminating the need for direct handling of the sponge or mop swabs. Further, most such current mop heads are designed for a single purpose or function, whether it be for swabbing a floor, or spreading a protective layer of polish thereon, for example.

U.S. Pat. No. 4,531,251, to Pappas et al., discloses a single purpose mop holder, where such mop holder comprises a support structure consisting of a pair of mating plate members, i.e. base and cover plates, engaging a mop head therebetween. More precisely, the support structure includes a base plate member having a plurality of projecting studs which are inserted through apertures in the backing material of a mop head. The base plate member also includes an internally threaded boss. A cover plate member is placed upon the base plate member of the support structure. The cover plate member includes apertures along its front edge aligned to receive the studs of the base plate member. A knurled screw is inserted through an aperture in the cover plate member and threadingly engaged to the threaded boss of the base plate member thereby securing the cover plate member to the base plate member and securing the mop head therebetween.

U.S. Pat. No. 5,155,875, to Kirkkala et al., discloses a rotary brush consisting of a cylindrical member having plural brush elements attached to and extending radially therefrom. The cylindrical member includes a plurality of longitudionally disposed rails, and the brush elements are mounted in a housing having a groove therealong sized for sliding engegement with a respective rail.

U.S. Pat. No. 5,349,715, to Lewis, Jr., discloses, as a preferred embodiment thereof, a tufted brush article that may be integral to a glove, for example, and to a process for manufacturing same. The article consists of a fabric having upper and lower surfaces with tufts disposed on the upper surface and a tuft receiving member disposed integrally with the tuft on the lower surface. The tuft receiving member typically includes a projection which registers on the tuft and extends through the fabric material. The projection is then melted and the tuft end fused so that the tuft can be mounted on the fused projection to form an integral connection. This is just another example of a single purpose cleaning product.

U.S. Pat. No. 5,524,314, to Dickinson et al., discloses a dual purpose mop holder consisting of a frame and a scraper component attached to the frame for removing stubborn materials from floors or baseboards, where the scraper has tapered sides terminating at a scraping edge and is provided with a plurality of teeth. This type of device appears to offer to the user the convenience of a single implement for addressing difficult areas to clean that may be encountered during a conventional mopping or cleaning operation. However, it does have its limitations due to the hard nature of the scraper teeth, and their natural tendency to mar the surface of the floor.

In many instances while mopping a floor, one may encounter particularly stubborn stains or encrusted material stuck to the floor. In these instances, the traditional mop itself is insufficient to remove or dislodge the stain. In the past, it has been necessary in many cases for janitorial personnel to carry an ancillary brush or scrubber for addressing such stubborn stains. When the stain was encountered, the janitor would put aside his mop, wet the ancillary brush or scrubber, and manually scrub the stain or encrusted material from the floor, whereupon the mopping operation could be continued. Obviously, this is an inefficient and time consuming process. Hard toothed scrapers, such as that shown in the Dickinson patent, are not satisfactory solutions because they tend to scratch and mar the surface of the floor. Further, the mop must be manipulated away from its normal mopping orientation in order to use the scraper.

Accordingly, there exists a need for a mop that will allow a user to mop a floor in the usual way, but that will also allow for the cleaning of stubborn stains and encrustations when encountered without interrupting the mopping operation and without requiring that the mop be manipulated in an awkward way to clean a stubborn stain. It is to the provision of such a mop that the present invention is primarily directed.

SUMMARY OF THE INVENTION

The present invention offers the user of the mop head hereof the convenience of addressing stubborn areas of cleaning, without causing damage to the surface to be cleaned, by the same mopping motions one normally may use in the mopping process. The manner by which this may be accomplished will become apparent to those skilled in the art from the following description, particularly when read in conjunction with the accompanying drawings.

Briefly described, the present invention is directed to a dual-purpose mop head assembly having an array of fused brush bristles extending laterally therefrom. The mop head assembly further includes conventional mopping yarns extending generally perpendicular relative to the fused brush bristles. The mop head assembly comprises an elongated housing, preferably formed of plastic, having a pair of side walls and a pair of end walls joined thereto, where the walls are defined by upper and lower edges. Intermediate to, and spaced internally from the edges, is a partition wall, where the partition wall, side and end walls, and lower edge define an elongated channel or trough into which the mopping yarns are secured. Additionally, the partition wall, side and end walls, and upper edge define a second pair of channels, longitudionally spaced by an intermediate wall of sufficient thickness to include a threaded recess to receive a complementary threaded, elongated handle. Projecting laterally from at least one of the side walls is an array of closly packed, relatively rigid, brush bristles, such that by lowering the handle to engage the floor with the bristles and proceeding with a normal mopping action one can use the bristles to remove or loosen scuff marks or other foreign matter on a floor. The handle can then be raised or flipped 180 degrees to continue the normal mopping process.

Accordingly, an object of this invention is to provide a convenient, dual-purpose, janitorial or household mop head assembly that can be used to address normal, as well as stubborn areas, of a floor to be cleaned, without having to set aside one implement for another, or to replace the mop head.

Another object hereof is the provision of a removable and discardable mop head assembly, when the mop is worn out, to be replaced by another mop head assembly.

This and other objects will become apparent to those skilled in the art from the specification which follows.

DETAILED DESCRIPTION OF PREFERRED EMBODIMENT

Figure 1:
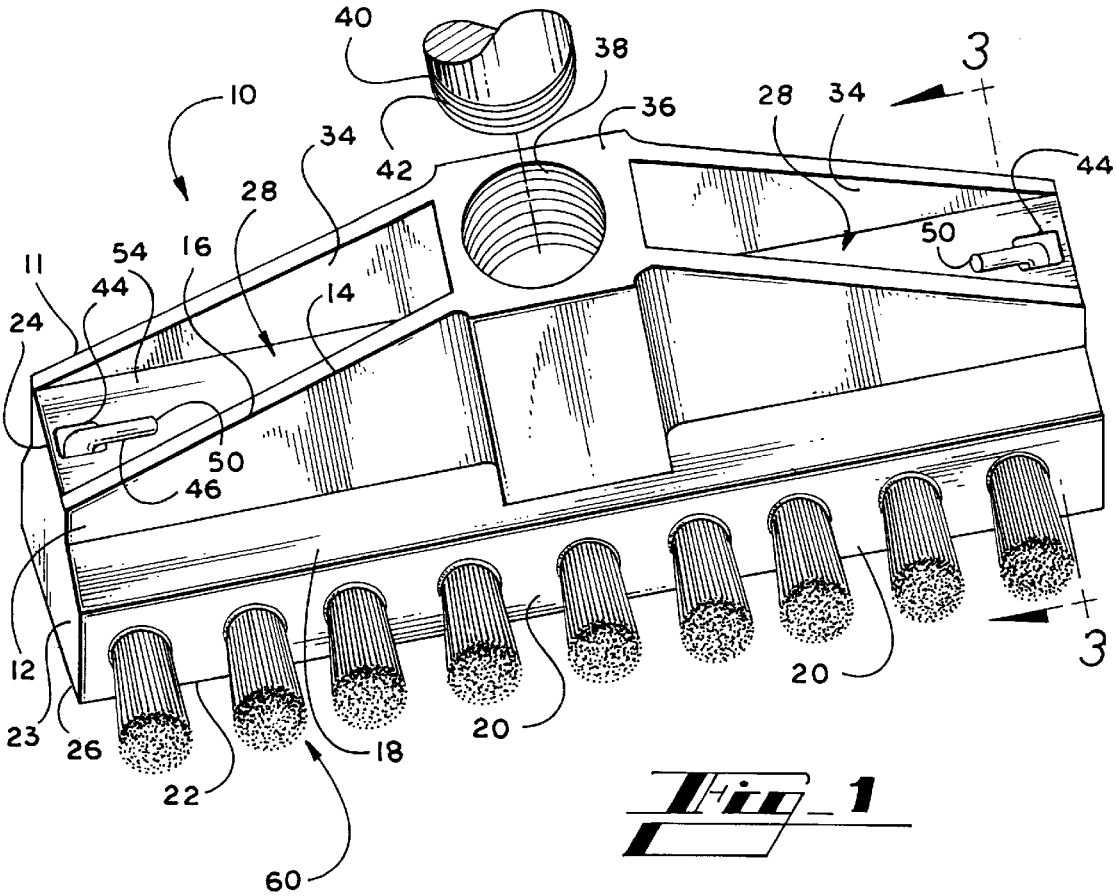
FIG. 1 is an exploded, top perspective view of the mop head assembly according to the invention, illustrating further the threaded engagement end of an elongated handle poised for mating engagement with the mop head housing thereof.

The present invention is directed to a dual-purpose mop head assembly including a housing having conventional mopping yarns extending therefrom, and an array of fused brush bristles laterally projecting from the housing, where such assembly is illustrated in the various views in which like reference numerals represent like components or features throughout the different views.

Figure 2:
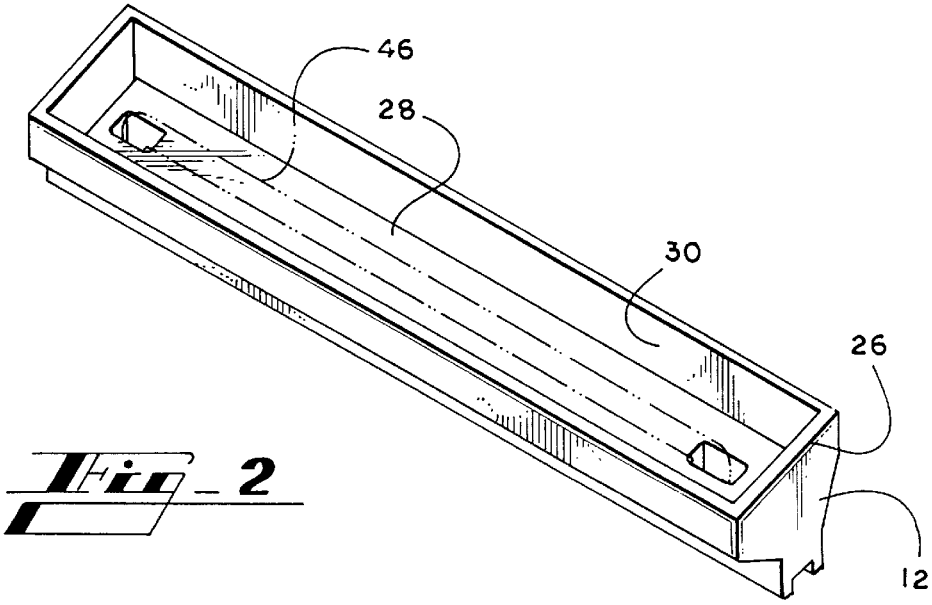
FIG. 2 is a bottom perspective view of the mop head housing, less the mopping yarns.
Figure 3:
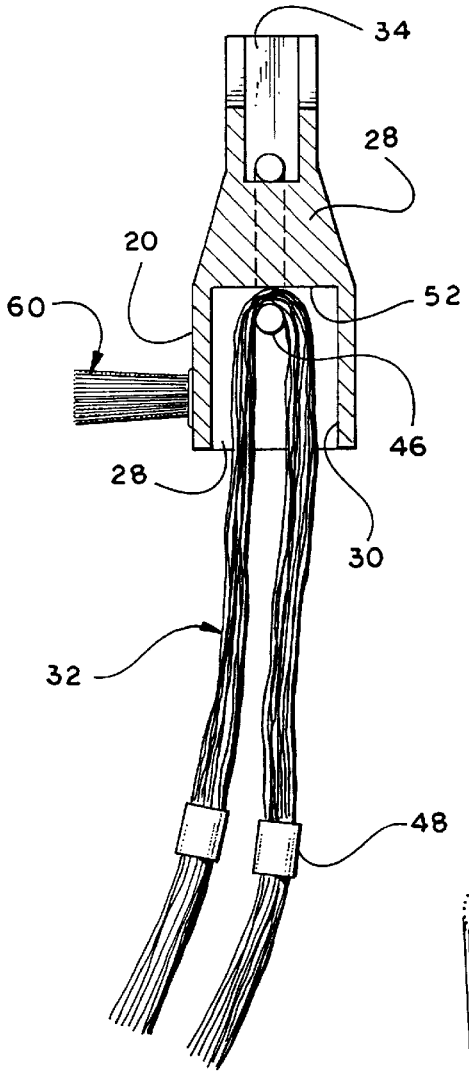
FIG. 3 is a lateral sectional view taken along line 3—3 of FIG. 1.

The mop head assembly 10, as illustrated in FIGS. 1 to 3, comprises an elongated housing 11 having a pair of side walls 12 consisting of an upper wall portion 14 extending from a top edge 16 to an intermediate, outwardly flared wall portion 18, and a downwardly extending wall portion 20 terminating at a bottom edge 22. Connecting the respective side wall portions are a pair of planar end walls 23 extending from top edges 24, coextensive with top edges 16, to bottom edges 26, which in turn are coextensive with bottom edges 22.

Internally of the housing 11, and intermediate the respective top edges 16, 24 and bottom edges 22, 26 is a partition wall 28, as best seen in the sectional view of FIG. 3. The partition wall 28, along with the wall portion 20, end walls 23, and bottom edges 22, 26, define a first channel 30 or trough, which, as will be explained hereinafter, receives the mopping yarns 32.

Cooperating with the respective top edges 16, 24, side and end walls, and the partition wall 28, there is formed a pair of aligned channels 34, separated by an intermediate wall 36. The intermediate wall 36, as best seen in FIG. 1, extends between opposing side walls 12 and is of such a thickness as to include a threaded recess 38 to receive a mop handle 40, as known in the art, having complementary threads 42 for threadably engaging the housing 11 in recess 38.

The partition wall 28 further includes a pair of through holes 44, located in close proximity to the end walls 23 for receiving a C-configured rod 46, such as made of aluminum, to retain the mopping yarns 32 within first channel 30, as explained hereafter. The mopping yarns 32 comprise a plurality of individual yarn elements, of a discrete length, that are looped with the respective ends thereof adjacent to one another, then secured together by a continuous, encircling tape 48 sewed thereto to maintain the relationship of the plural mopping yarns 32. By this arrangement, and with the respective yarn loops aligned, the C-configured rod 46 may be inserted therethrough, then with the ends 50 thereof directed upwardly, inserted into the holes 44. With the mopping yarns 32 closely pressed to the lower surface 52 of partition wall 28, the respective rod ends 50 may be bent laterally to override the upper surface 54 of partition wall 28. With the C-configured rod 46 so positioned, the mopping yarns are securely held within the first channel 30.

Figure 4:
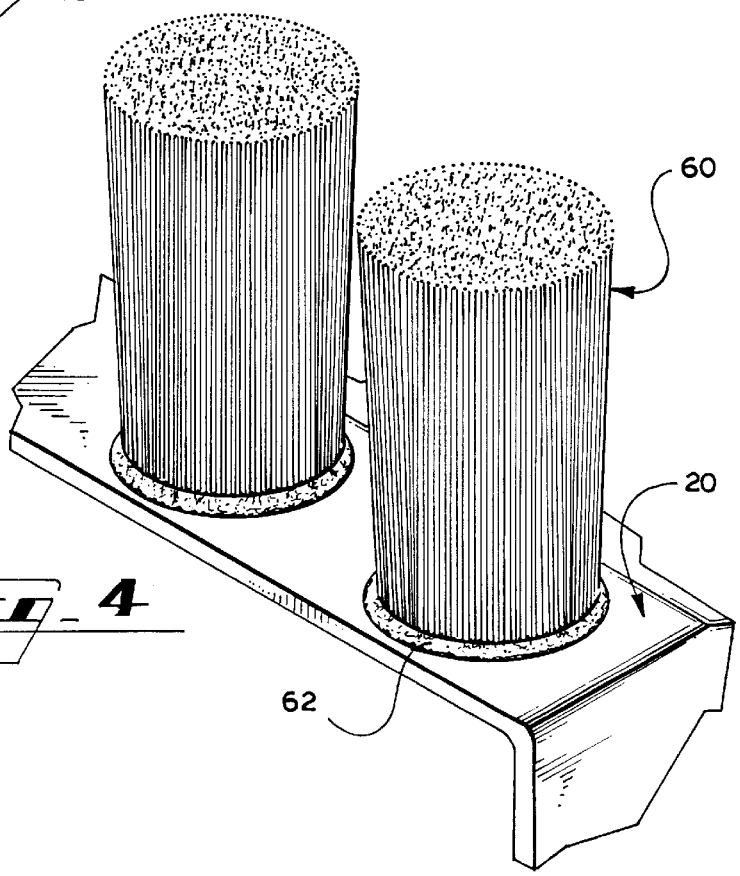
FIG. 4 is an enlarged perspective view of two exemplary, closely packed brush bristles secured within the side wall of the mop head assembly hereof.

An important and unique feature of the dual-purpose mop head assembly 10 of this invention is the provision of an array of brush bristles 60 fused to and projecting laterally from at least one said side wall portion 20, see FIG. 4. To position and fuse the bristles to said side wall portion 20, a plurality of bristle elements, such as polypropylene monofilament, may be closely packed within a cylindrical tube or within a tubular recess formed in a mold, where the filament or bristle ends 62, which extend beyond the tube end, are heated and fused by the application of localized heat. Thereafter, the housing, or at least the side wall 20, is heated to a point of softening, whereupon the fused ends 62 are brought into contact and secured thereto. After slidably removing the tube(s) and cooling, the integral mop head assembly 10 thus formed is capable of performing the dual functions of conventional swabbing and attending to stubborn areas requiring application of relatively rigid brush bristles, without having to switch or search for a different implement.

With the mop head assembly fabricated, as described above, and attached to a mop handle, it may be used as follows to clean a floor and address stubborn stains. For traditional mopping, with the rigid brush bristles extending upward and out of contact with the floor, the mopping yarns may be applied to the floor for back and forth swabbing, as known in the cleaning trade.

However, when that occasional stubborn area is encountered, the mop handle is simply lowered to engage the bristles with the floor or, if the other side of the mop is currently being used for mopping, the head assembly is rotated 180 degrees before lowering of the handle whereupon the rigid brush bristles contact the floor to be applied to such stubborn area. To return to traditional mopping, the mop handle is simply raised or the mop head assembly is again flipped with the rigid brush bristles extending upward to disengage the bristles from the floor. When the mop head assembly becomes worn, the entire head is simply detached and discarded, and a new mop head assembly threadably secured to the handle for continued cleaning. In this regard, the entire structure, including the mop head, mopping yarns, and scrubbing bristles, are thrown away and replaced with a fresh assembly. The discardable nature of the assembly is one of the benefits of the fused bristle array because of its low cost of manufacture.

While a preferred embodiment has been described above, it is recognized that variations may be made with respect to the components for the mop head assembly of this invention. Therefore, while the invention has been disclosed in preferred forms only, it may be obvious to those skilled in the art that additions, deletions and modifications can be made therein without departing from the spirit and scope of this invention, and that no undue limits should be imposed thereon except as set forth in the following claims.

I claim:

1. A mop head assembly having an array of fused brush bristles extending therefrom, said assembly comprising an elongated housing formed by a pair of side walls and a pair of end walls joined thereto, where said walls extend between top and bottom edges, and an intermediate, longitudional partition extending between said top and bottom edges, a vertically extending wall from said partition to said top edges, between said side walls and spaced from said end walls, where said vertically extending wall includes a recess for receiving a handle, a first elongated channel, defined by said partition, said side and end walls, and said bottom edges, having plural mopping yarns secured therewithin and extending from said elongated channel, and an array of relatively rigid brush bristles extending laterally from one said side wall.

2. The mop head assembly according to claim 1, wherein said vertically extending wall separates a pair of second, longitudionally, aligned elongated channels defined by said partition, said side walls and a respective end wall, and said top edges, where said partition in close proximity to each said end wall includes through holes, and a C-configured metal rod extending through said holes and cooperating with said second channels to secure said mopping yarns within said first channel.

3. The mop head assembly according to claim 2, wherein said mopping yarns include a plurality of discrete yarn elements, of a predetermined length, where said yarn elements are looped about said C-configured metal rod for securing same within said first elongated channel.

4. The mop head assembly according to claim 3, wherein each said yarn element includes a pair of free ends, and that adjacent yarn elements, in proximity to said free ends, are secured to one another by a continuous, encircling tape.

5. A mop head assembly comprising a plastic housing having a threaded bore for mounting said mop head assembly to one end of a mop handle, said housing having a pair of spaced side walls that define an elongated channel, a plurality of mopping yarns secured within and extending from said elongated channel, and a plurality of plastic bristle bundles projecting from at least one of said side walls, each of said plastic bristle bundles being formed from a plurality of elongated plastic bristles melted together and melted to said side wall at one end to fuse said bristle bundles to said side wall.

6. A mop head assembly as claimed in claim 5 and wherein said plastic bristle bundles project from said housing at a substantially right angle relative to a mop handle mounted to said mop head assembly.

7. A mop head assembly as claimed in claim 6 and wherein said plurality of plastic bristle bundles are aligned along said housing to form a linear array of bristle bundles.

8. A mop head with integral fused brush array, said mop head comprising an elongated housing having a pair of side walls that bound and define an elongated channel, a threaded receptacle on said housing for receiving an end of a mop handle, mopping yarns secured within said elongated channel and extending therefrom, and a plurality of elongated brush tufts each melted and fused at one end to one of said side walls and projecting outwardly therefrom.

* * * * *